United States Patent [19]

Jeppson, III et al.

[11] Patent Number: 5,022,168

[45] Date of Patent: Jun. 11, 1991

[54] FOOTWEAR INSERT

[76] Inventors: John Jeppson, III, 94 Lake Rd., Brookfield, Mass. 01506; Joseph P. Herlihy, 92 Middleton Rd., Boxford, Mass. 01921

[21] Appl. No.: 540,681

[22] Filed: Jun. 20, 1990

Related U.S. Application Data

[63] Continuation-in-part of Ser. No. 389,373, Aug. 4, 1989.

[51] Int. Cl.[5] ..... A43B 13/40

[52] U.S. Cl. ..... 36/43; 36/71; 36/30 R

[58] Field of Search ..... 36/43, 44, 71, 28, 30 R

[56] References Cited

U.S. PATENT DOCUMENTS

| | | | |
|---|---|---|---|
| Re. 24,007 | 5/1955 | Foster | 28/72 |
| 1,923,169 | 8/1933 | Simmons | 36/44 |
| 2,284,947 | 6/1942 | Clifford | 36/44 |
| 2,425,388 | 8/1947 | Oestricher | 36/44 |
| 2,627,644 | 2/1953 | Foster | 28/279 |
| 2,713,193 | 7/1955 | Robbins, II et al. | 28/278 |
| 3,005,277 | 10/1961 | Shelare et al. | 36/29 |
| 3,009,232 | 11/1961 | Martin | 28/72 |
| 3,015,149 | 1/1962 | Foster et al. | 28/78 |
| 3,785,646 | 1/1974 | Ruskin | 272/57 D |
| 3,906,185 | 9/1975 | Gross et al. | 215/211 |
| 4,005,532 | 2/1977 | Giese | 36/44 |
| 4,062,131 | 12/1977 | Hsiung | 36/44 |
| 4,073,072 | 12/1978 | Gross et al. | 36/44 |
| 4,186,499 | 2/1980 | Massok, Jr. | 36/44 |
| 4,219,945 | 9/1980 | Rudy | 36/29 |
| 4,236,326 | 12/1980 | Inohara | 36/29 |
| 4,297,796 | 11/1981 | Stirtz et al. | 36/28 |
| 4,364,189 | 12/1982 | Bates | 36/31 |
| 4,391,048 | 7/1983 | Lutz | 36/28 |
| 4,535,553 | 8/1985 | Derderian et al. | 36/28 |
| 4,536,974 | 8/1985 | Cohen | 36/28 |
| 4,656,760 | 4/1987 | Tonkel | 36/28 |
| 4,729,179 | 3/1988 | Quist, Jr. | 36/28 |
| 4,813,161 | 3/1989 | Lesley | 36/28 |
| 4,864,740 | 9/1989 | Oakley | 36/44 |
| 4,906,502 | 3/1990 | Rudy | 36/29 |

FOREIGN PATENT DOCUMENTS

| | | | |
|---|---|---|---|
| 7713557 | 8/1979 | Sweden | 36/43 |
| 2193427 | 2/1988 | United Kingdom | 36/43 |

*Primary Examiner*—Steven N. Meyers
*Attorney, Agent, or Firm*—Lorusso & Loud

[57] ABSTRACT

A footwear insert comprising a first fabric layer having first strands extending widthwise thereof and second strands extending lengthwise thereof and interwoven with the first strands, a second fabric layer having third strands extending widthwise thereof and fourth strands extending lengthwise thereof and interwoven with the third strands, fifth strands extending widthwise of the insert and disposed between the first and third strands and forming walls transverse to the first and second layers, and sixth strands extending lengthwise of the insert and interwoven with the first, third and fifth strands, the sixth strands forming loops substantially larger in size than loops formed by the second and fourth strands, the first and second layers and the walls forming voids bound in part by the sixth strands.

17 Claims, 3 Drawing Sheets

FOOTWEAR INSERT

CROSS-REFERENCE TO RELATED APPLICATION

This is a continuation-in-part of patent application Ser. No. 07/389,373, filed Aug. 4, 1989, in the name of John Jeppson III and Joseph P. Herlihy.

BACKGROUND OF THE INVENTION

1. Field of the Invention

The present invention relates to footwear and is directed more particularly to an insert, a shoe including the insert, and methods for making same.

2. Description of the Prior Art

There have been numerous attempts to provide an insert for use in footwear that will maintain comfortable temperature of a foot by allowing air to circulate freely around the foot and directing moisture away from the foot. Moisture creates a problem in both cold and warm weather because of its high degree of temperature conductivity. Accordingly, dissipation of moisture underfoot is critical in stabilizing temperature of the foot.

There have also been attempts to provide a footwear insert with substantial cushioning, impact absorption and energy return capabilities. In addition to providing added comfort, these features prevent damage to the foot during exercise. It is desirable to provide an insert which will withstand the forces of impact over a long period of time.

In U.S. Pat. No. Re 24,007 there is disclosed a corrugated fabric that is resilient and is capable of returning repeatedly to its hollow shape after it is compressed. The fabric permits the free flow of air along its corrugated channels. It has good insulating properties to provide protection from heat or cold. It was originally thought that the material could be used as an insert for the sole of a shoe to provide cushioning, or as a liner for cold weather boots to provide thermal insulation. It was found, however, that pressures on the fabric in use caused flattening of the corrugated separating fabric, with the result that the air channels between the two woven fabrics were so compressed that insulation due to the air in the corrugated channels and cooling due to circulation of air through the channels, were substantially eliminated.

U.S Pat. No. 4,073,072 to Gross sought to eliminate problems of collapsible air channels by providing a structure comprising two mesh-like fabrics woven from a solid monofilament plastic material, which fabrics are separated by corrugated separating material. The two fabrics are joined to the separating material, such that the separating material forms a structure which resists deformation of the first and second mesh-like plastic fabrics toward each other upon application of a compressive force. Although the structure provides an air space, it does not provide for energy return. In addition, the structure will not compress to a degree that allows for pumping action to assist air in circulating around the foot.

As noted above, cushioning and energy return are beneficial attributes of a footwear insert. U.S. Pat. No. 4,656,760 to Tonkel, et al, shows a cellular insert formed of a series of cellular shaped components having voids filled with foam and forming part of the sole of a shoe. The insert serves as a means for reinforcing the foam which cushions, or absorbs, the forces of impact exerted upon the shoe during use. Disadvantages of this insert are that it lacks space for air to circulate and, thus, can cause the foot to become excessively hot or cold, and the insert allows moisture to build up on the foot.

SUMMARY OF THE INVENTION

An object of the present invention is to provide a footwear insert that will insulate the foot from extremes of temperature.

A further object of the invention is to provide a footwear insert that provides for moisture dissipation and air circulation.

A further object of the invention is to provide a footwear insert having provision for air circulation to the bottom of the foot, as well as throughout the entire shoe and surface of the foot.

A still further object of the present invention is to provide a footwear insert having cushioning to prevent damage to the foot from heavy pressure loads.

Another object of the present invention is to provide a footwear insert providing for impact absorption and energy return during running or other foot exercises.

A still further object of the invention is to provide a method for making a footwear insert of the type above described.

Still another object of the invention is to provide a shoe having as a component thereof an insert portion, as above described.

Another object of the invention is to provide a method for making a shoe, utilizing the above described insert.

With the above and other objects in view, as will hereinafter appear, a feature of the present invention is the provision of a footwear insert comprising a first fabric layer comprising first strands extending widthwise of the insert and second strands extending lengthwise of the insert and interwoven with the first strands, a second fabric layer comprising third strands extending widthwise of the insert and fourth strands extending lengthwise of the insert and interwoven with the third strands, fifth strands extending widthwise of the insert and disposed between the first and third strands and forming walls transverse to the first and second layers, and sixth strands extending lengthwise of the insert and interwoven with the first, third and fifth strands, the sixth strands forming loops substantially larger in size than loops formed by the second and fourth strands, the first and second layers and the walls forming voids bound in part by the sixth strands.

In accordance with a further feature of the invention, there is provided a method for making a footwear insert, the method comprising the steps of providing a first fabric layer having first strands extending widthwise thereof and second strands extending lengthwise thereof, the first and second strands being interwoven, providing a second fabric layer having third strands extending widthwise thereof and fourth strands extending lengthwise thereof, the third and fourth strands being interwoven, providing fifth strands extending widthwise thereof and locating the fifth strands between the first and third strands to form walls transverse to the first and second layers, and providing sixth strands of a material different from the second and fourth strands extending lengthwise thereof, interweaving the sixth strands with the first, third and fifth strands forming loops with the sixth strands, thereby forming voids bounded by the first and second layers, the walls and the sixth strands.

In accordance with a still further feature of the invention, there is provided a shoe comprising an outer sole, the outer sole having a cavity therein, an insert as described above disposed in the cavity and substantially filling the cavity, and an upper fixed to the outer sole.

In accordance with a still further feature of the invention, there is provided a method for making a shoe, comprising forming a cavity in an outer sole, forming a shoe insert as discussed above, cutting the insert to a size and configuration complementary to the cavity, inserting the insert in the cavity, and fixing an upper to the outer sole.

The above and other features of the invention, including various novel details of construction and combinations of parts, will now be more particularly described with reference to the accompanying drawings and pointed out in the claims. It will be understood that the particular devices and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

DESCRIPTION OF THE PREFERRED EMBODIMENTS

Figure 1:
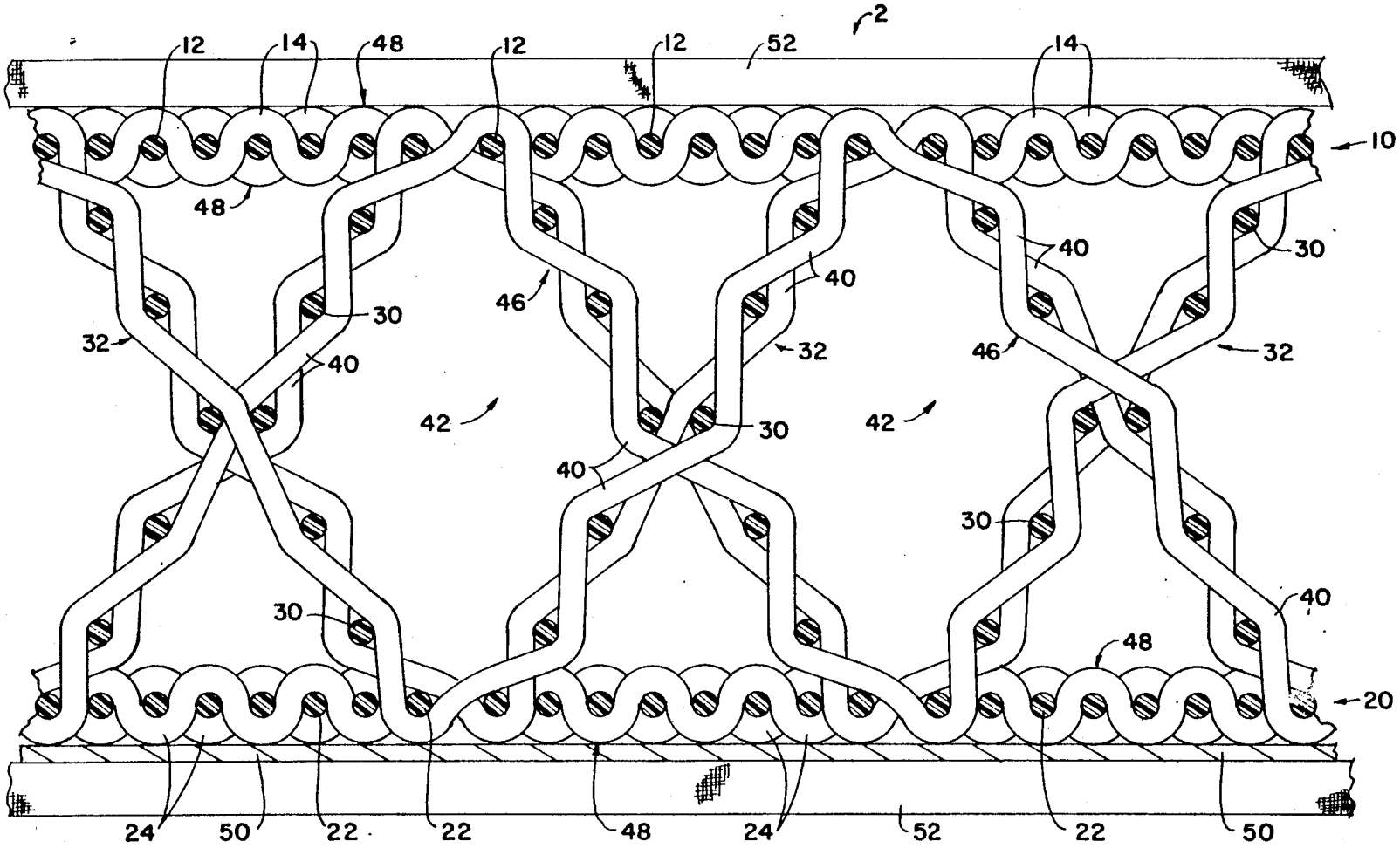
FIG. 1 is an enlarged diagrammatic view of a fabric construction for one form of insert illustrative of an embodiment of the invention.

Referring to the drawings, particularly FIG. 1, it will be seen that an illustrative footwear insert 2 includes a first fabric layer 10 comprising first strands 12 extending widthwise of the insert 2 and second strands 14 extending lengthwise of the insert and interwoven with the first strands 12. The insert further includes a second fabric layer 20 comprising third strands 22 extending widthwise of the insert and fourth stands 24 extending lengthwise of the insert and interwoven wit the third stands 22.

The insert 2 further includes fifth strands 30 extending widthwise of the insert and disposed between the first and third strands 12, 22 and forming walls 32 transverse to the first and second fabric layers 10, 20.

The insert 2 still further includes sixth strands 40 extending lengthwise of the insert and interwoven with the first, third and fifth strands 12, 22, 30. The sixth strands form loops 46 substantially larger in size than loops 48 formed by the second and fourth strands 14, 24.

The first and second fabric layers 10, 20 and the walls 32 are arranged, as shown in FIG. 1, to form voids 42 bound in part by the sixth strands 40.

The first, third and fifth strands 12, 22, 30 preferably are of polypropylene, polyvinylidine chloride, nylon or polyester material and are of a diameter of about 0.005–0.020 inch. The second and fourth strands 14, 24 preferably are of low density polyethylene and have a diameter of about 0.005–0.020 inch before the heating process. The sixth strands 40 preferably are of polypropylene or polyvinylidine chloride and have diameters of about 0.008–0.030 inch.

The woven structure illustrated in FIG. 1 is provided with strands having different shrinkage rates when subjected to heat. After the structure is woven, it is subjected to a temperature of about 200° F. to cause heat shrinkable second and fourth strands 14, 24 to shrink, forming the small loops 48, whereas non-shrinkable strands 40 remain substantially at the same length and thus cause the woven construction upper and lower layers 10, 20, to be maintained in a separated position by the large loops 46 of the non-shrinkable strands 40. The low density polyethylene used for the heat shrinkable strands 14, 24 shrink 30–50% when subjected to temperatures in the order of 200° F.

The above described woven structure is especially designed to provide air circulation around the foot. The primary means for insulating the foot from the extremes of temperature is by use of circulating air, not merely in the sole cavity, but more importantly, from below the foot up to the foot bottom and surrounding area where the greater extremes of temperature are more acutely felt. Air circulation is achieved with this fabric in two ways. First, the fabric is very light relative to the space it occupies and it is a three dimensional object, so there is air space created by the construction of the fabric. Secondly, the fabric is constructed such that it will flex and compress under the pressure of the foot and return to its original space as pressure is released. The large loops 46 have sufficient resiliency to permit the spaced layers 10, 20 to compress upon the application of pressure, and to return to their normal spaced relationship upon release of the pressure. After the fabric is compressed, it returns to its original position, so that as the device is walked on, the heel to toe motion of the foot pushes air out and allows the air to come back in a pumping fashion. Thus, when the heel portion or forefoot of the shoe is pressed down, the fabric is compressed and the air escapes. When the pressure is relieved, the woven spaces of the fabric reopen and the air comes back in. The air will circulate continuously by the use of peristaltic pumping action throughout the mass of the woven structure and will be vented to the foot bottom and surrounding area.

In this manner, the device of the present invention creates what is known as a micro-climate inside the shoe by allowing the excellent insulating properties that air provides to establish a stabilized temperature underfoot for prolonged periods.

In addition to providing air circulation, the voids 42 between the two layers 10, 20 of the fabric provide an area to which moisture ma be carried from the foot by the hydrophobic materials used in manufacture of the insert.

A fabric can be engineered, using the above-described woven structure, which will effectively support any given pressure and still provide the desirable characteristics enumerated above. The interplay of variables is referred to as the "tuning" aspect of the invention. Generally, a cavity having greater area requires a less dense fabric because the weight of the wearer will be spread over the layer area. For example, in a whole shoe sole cavity, a less dense fabric may be required to support the same pressure than that required for a smaller cavity. However, area is not the only determinant, but also the volume to be filled with the woven fabric. The tuning aspect of the invention involves the ability to tune a fabric for a particular size shoe, given the knowledge that a certain percentage of men or women who wear a particular size shoe fall within a specific weight range. Thus, the fabric may be tuned for each particular shape of cavity to achieve optimum density and therefore to optimize the other characteristics of the insert. To accommodate the higher pressures associated with running, a shoe for that purpose would carry a differently tuned fabric from the fabric that would be used in the same shoe and cavity to support an activity, such as standing in front of a machine. The fabric needed to support a person having a shoe with a partial insert in a small cavity may be more dense than the fabric needed to support that person having a shoe with a whole shoe sole cavity and whole insert. In conclusion, different size cavities will require fabrics of different characteristics, given a specific range of user weights, or uses, such as standing, walking or running.

It is important to achieve the proper percentage of shrinkage in the woven structure for the particular use intended for the device. For example, the percentage of shrinkage of the second and fourth strands 14, 24 will affect the shape and the size of the voids 42 formed between the two layers 10, 20 of the woven structure. As the percentage of differential shrinkage of the yarns increases, the voids formed between the two layers tend to become more oval, with the longer axes of the ovals being vertical. As the percentage of differential shrinkage decreases, the voids tend to flatten out. The depth of the voids will vary, depending upon the type of shoe sole and the type of construction. In fashion footwear, thinner construction may be required, and horizontal or flattened void may be helpful.

Depending upon the type of shoe, the insert may be as thin as 1/16 of an inch and as thick as ½ of an inch. The thinner inserts are traditionally used in fashion footwear. Thicker inserts may be used in boots, athletic shoes, or casual shoes which are designed with a thicker sole and which often are designed to provide more cushioning and greater energy return characteristics.

It is critical that the large loops 46 do not fold, move laterally or permanently compress. Only in an upright position will the loops 46 keep the voids 42 open while subject to foot pressure to allow air to circulate, and only in that position will the device maintain its resilient spring-like feature.

The invention finds utility in generally two types of devices: (1) in a shoe provided with a formed cavity in which an insert is placed; and (2) a "free standing" insert which may be inserted into a finished shoe.

The free standing insert (FIGS. 2 and 3) is made by cutting the woven structure and a backing material 50 (FIG. 1) into a shape that will fit within a shoe. The woven structure and the backing material 50 are attached to each other and then covered with an outer cover material 52 (FIGS. 1, 2 and 3) which attaches to the backing material. The cover material 52 is preferably hydrophobic to provide a wicking action into the insert which permits circulation of air therethrough and subsequent dissipation of moisture. The free standing insert can also be formed by layering a sheet of the woven structure between a sheet of backing material 50 and a sheet of covering material 52, and then cutting the sole-shaped figure from the composite fabric with a die that seals the insert at its perimeter.

The outer cover 52 may be made from any material that will withstand the friction caused by the action of the foot against the outer cover and the action of the outer cover against the woven fabric. The outer cover may also be a porous fabric so that it will promote air circulation. The provision of a hydrophobic air permeable cover for the footwear insert 2 provides a wicking action into the woven structure which permits circulation of air therethrough, and wicking of moisture away from the foot, keeping the foot dry and enhancing the insulation and air circulation characteristics of the insert. A fabric made of synthetic hydrophobic fibers, such as polypropylene or polyester is preferred.

The backing material 50 may be any material which will prevent the woven fabric from becoming damaged by rubbing contact with a shoe cavity wall. It may also have properties of its own which would enhance the insulation or ventilation properties of the device, e.g., a reflective foil which would use the body's own thermostatic mechanism to reflect its normal temperature throughout the air mass within the insert and back to the foot bottom.

Figure 2:
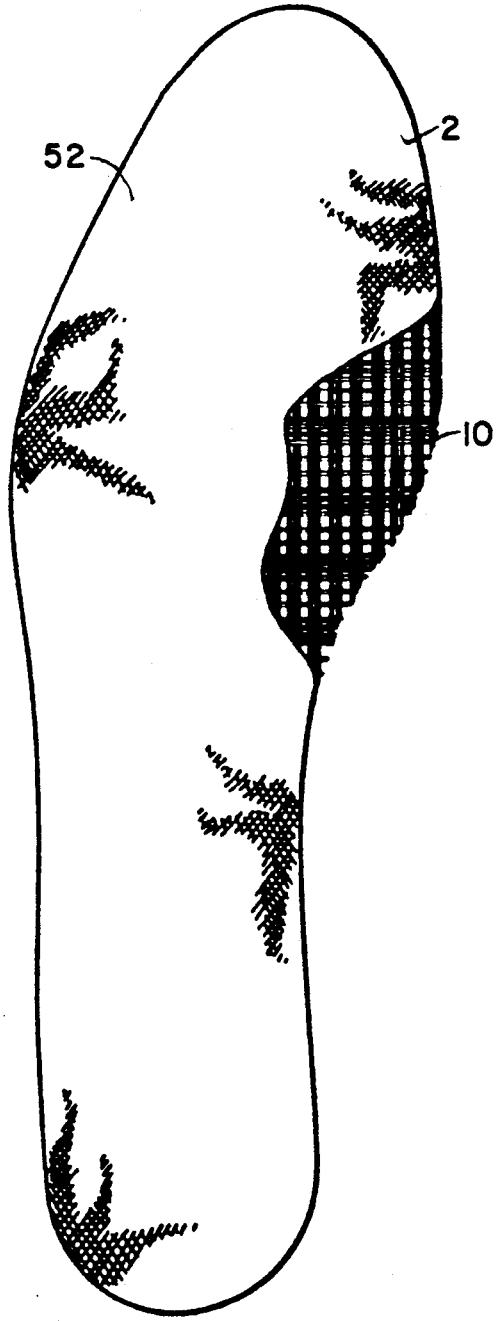
FIG. 2 is a top plan view of an insert made of the fabric shown in FIG. 1.
Figure 3:
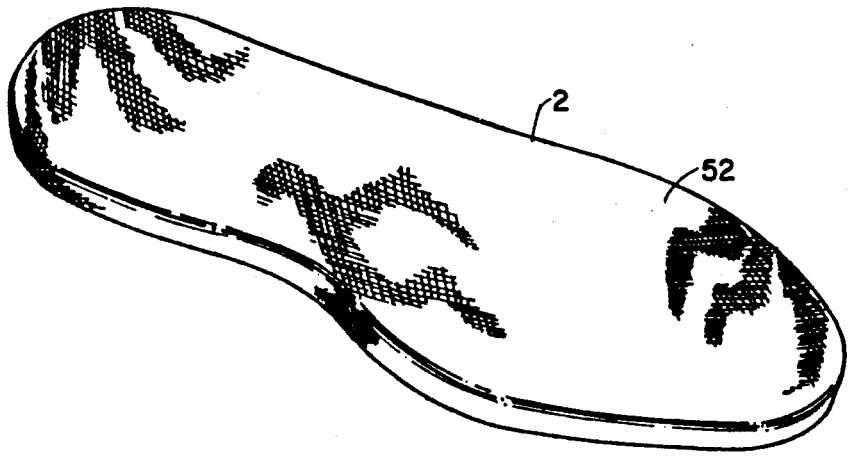
FIG. 3 is a perspective view of the insert of FIG. 2.
Figure 4:
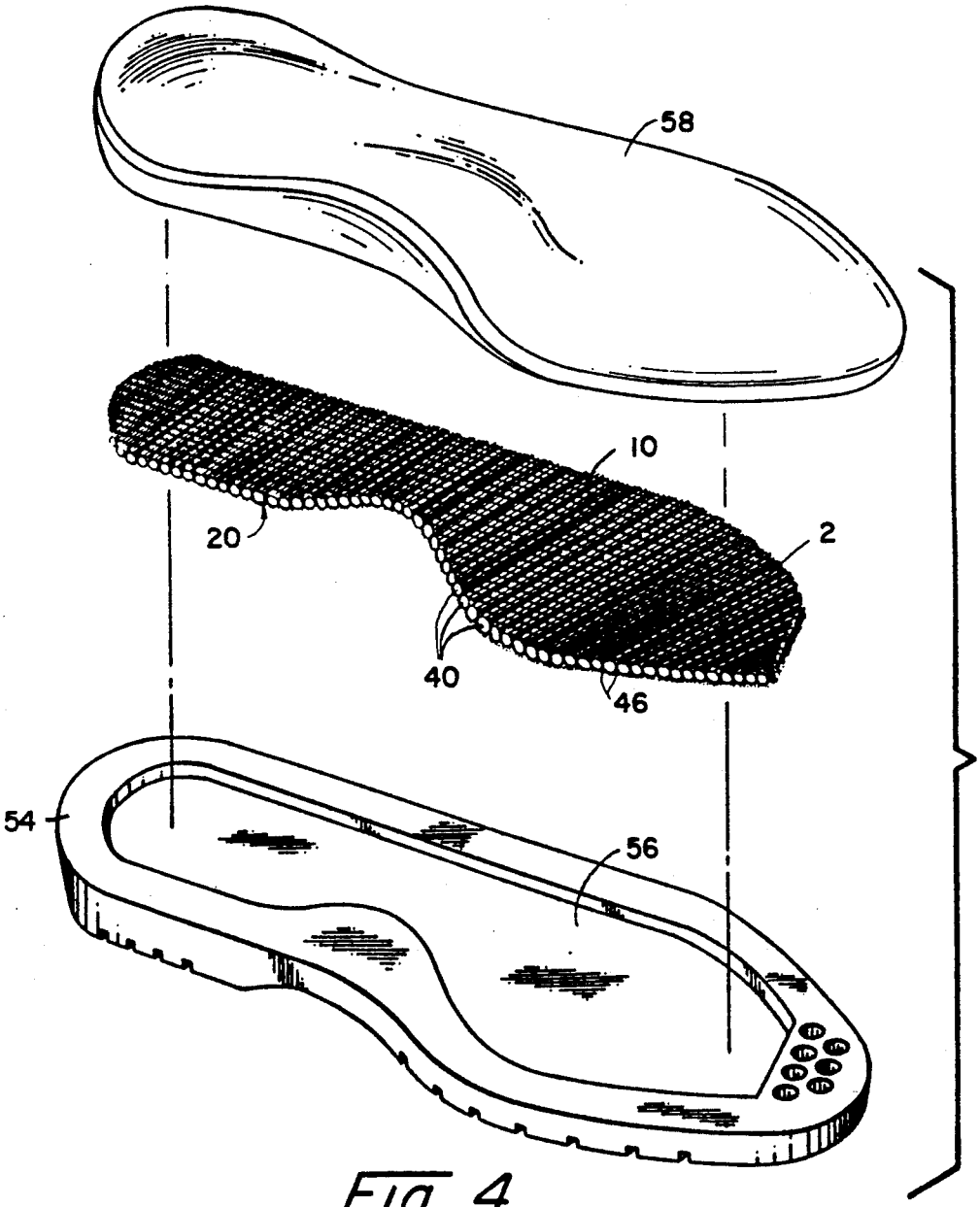
FIG. 4 is an exploded perspective view showing use of the fabric of FIG. 1 in the construction of a shoe.

The shoe with an insert in a formed cavity is provided by first making a sole 54 (FIG. 4) having one or more cavities 56 on the surface. The insert 2 is then cut to fit snugly within each cavity 56. In this construction, it is essential that the large loops 46 are arranged vertically and that there is no lateral displacement of the loops 46. The device may extend above the level of the perimeter of the cavity, depending upon the compression resistance required. An upper (not shown) is then attached to the sole 54 in a fashion well known in the art. An insole 58 is then placed in the upper, and attached to the upper surface of the insert 2. As shown in FIG. 4, the insert 2 may comprise only the basic woven structure, without backing and covering material. However, it is expected that in most uses a preferred embodiment will include the backing material 50 and cover material 52, as illustrated in FIGS. 1, 2 and 3. Thus, in the making of a shoe, there is provided a sole with a cavity therein into which the insert is placed. The upper, or a midsole (not shown), or the insole, i.e. a sole means, is then placed on top of the outer sole and insert composite. The upper is then bonded and/or stitched to the outer sole 54, to complete the shoe construction.

It is to be understood that the present invention is by no means limited to the particular construction herein disclosed and/or shown in the drawings, but also comprises any modifications or equivalents within the scope of the disclosure.

Having thus described our invention, what we claim as new and desire to secure by Letters Patent of the United States is:

1. A footwear insert comprising a first fabric layer comprising first strands extending widthwise of said insert and second strands extending lengthwise of said insert and interwoven with said first strands, a second fabric layer comprising third strands extending widthwise of said insert and fourth strands extending lengthwise of said insert and interwoven with said third strands, fifth strands extending widthwise of said insert and disposed between said first and third strands and forming walls transverse to said first and second layers, and sixth strands extending lengthwise of said insert and interwoven with said first, third and fifth strands, said sixth strands forming loops substantially larger in size than loops formed by said second and fourth strands, said first and second layers and said walls forming voids bound in part by said sixth strands, said insert being configured and adapted for use in conjunction with a sole of a shoe.

2. The footwear insert in accordance with claim 1 in which said second and fourth strands are substantially more heat shrinkable at a given temperature than said sixth strands.

3. The insert in accordance with claim 2 in which said second and fourth strands comprise a low density polyethylene.

4. The insert in accordance with claim 3 in which said sixth strands comprise a material selected from polypropylene and polyvinylidine chloride.

5. The insert in accordance with claim 4 in which said sixth strands have a diameter of about 0.008–0.030 inch.

6. The insert in accordance with claim 3 in which said second and fourth strands have a diameter of about 0.005–0.020 inch before subjected to heat.

7. The footwear insert in accordance with claim 1 and further including a layer of covering material bonded to said first fabric layer.

8. The insert in accordance with claim 7 in which said covering material is a porous fabric.

9. The insert in accordance with claim 8 in which said porous fabric is of a synthetic hydrophobic material.

10. The footwear insert in accordance with claim 1 and further including a layer of backing material bonded to said second fabric layer.

11. The insert in accordance with claim 10 in which said backing material is of a reflective foil material.

12. The footwear insert in accordance with claim 10 and further including a layer of covering material bonded to said first fabric layer, which covering material extends around said insert and covers said backing material.

13. A method for making a footwear insert comprising the steps of providing a first fabric layer having first strands extending widthwise thereof and second strands extending lengthwise thereof, said first and second strands being interwoven, providing a second fabric layer having third strands extending widthwise thereof and fourth strands extending lengthwise thereof, said third and fourth strands being interwoven, providing fifth strands extending widthwise thereof and locating said fifth strands between said first and third strands to from walls transverse to said first and second layers, and providing sixth strands of a material different from said second and fourth strands extending lengthwise thereof, interweaving said sixth strands with said first, third and fifth strands to form loops with said sixth strands, thereby forming voids bounded by said first and second layers, said walls and said sixth strands, said insert being configured and adapted for use in conjunction with a sole of a shoe.

14. The method in accordance with claim 13 and including the additional step of subjecting the insert to a temperature sufficient to shrink said second and fourth strands about 30–50% while leaving substantially less shrunken said sixth strands, thereby rendering loops formed by said second and fourth strands substantially smaller than said loops formed by said sixth strands.

15. The method in accordance with claim 13 and including the additional step of bonding a covering material to said first layer.

16. The method in accordance with clam 13 and including the additional step of bonding a backing material to said second layer.

17. The method in accordance with claim 16 and including the additional step of bonding a covering material to said first layer, wrapping said covering material around said insert, and bonding said covering material to said backing material.

* * * * *